US008225448B2

(12) United States Patent
Vasilakes et al.

(10) Patent No.: US 8,225,448 B2
(45) Date of Patent: Jul. 24, 2012

(54) LINT ROLLER

(75) Inventors: Lloyd S. Vasilakes, Stillwater, MN (US); Michael C. Molinet, Woodbury, MN (US); Paul N. Daveloose, St. Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 12/959,853

(22) Filed: Dec. 3, 2010

(65) Prior Publication Data

US 2012/0137457 A1 Jun. 7, 2012

(51) Int. Cl.
*A47L 25/00* (2006.01)

(52) U.S. Cl. ..... 15/104.002; 15/230.11; 492/13; D4/122

(58) Field of Classification Search ..... 15/104.002, 15/230.11; 492/13, 19; D4/122
See application file for complete search history.

(56) References Cited

U.S. PATENT DOCUMENTS

| | | | | | |
|---|---|---|---|---|---|
| 3,158,887 | A | * | 12/1964 | Kanbar et al. | 15/104.002 |
| 4,128,909 | A | * | 12/1978 | Kawabe et al. | 15/104.002 |
| 5,878,457 | A | | 3/1999 | Cox et al. | |
| 5,940,921 | A | | 8/1999 | Wood et al. | |
| 2008/0086828 | A1 | * | 4/2008 | Major | 15/230.11 |

FOREIGN PATENT DOCUMENTS

| | | | |
|---|---|---|---|
| DE | 4432964 | * | 3/1996 |
| GB | 2400022 | * | 10/2004 |
| JP | 2004-221105 | * | 8/2004 |
| JP | 2007-152069 | * | 6/2007 |

* cited by examiner

*Primary Examiner* — Mark Spisich
(74) *Attorney, Agent, or Firm* — Trisha D. Adamson

(57) ABSTRACT

Disclosed is a lint roller having a handle, and first roll of tape and a second roll of tape. The handle has a support having a first portion and a second portion. The first roll of tape has an outwardly facing surface with adhesive and rotatable about the first portion of the support. The second roll of tape has an outwardly facing surface with adhesive and rotatable about the second portion of the support.

13 Claims, 3 Drawing Sheets

LINT ROLLER

BACKGROUND

The present disclosure relates to a lint roller. In particular, the present disclosure relates to a lint roller having a handle that supports at least a first tape roll and a second tape roll.

Lint rollers have a handle that rotatably supports a roll of lint tape. A lint tape is a tape backing with the adhesive on an outwardly extending surface. A typical lint roller is the Scotch™ Lint Roller available from 3M Company, St. Paul Minn. Lint rollers are very effective at picking up loose lint, hair, and other debris from a surface such as clothing, bedding or furniture. When the outer sheet becomes loaded with debris, it is removed to expose a new, clean sheet. For large items, such as bedding, the outer sheet on the lint roller can become loaded with debris quickly such that the outer sheet must be removed often.

SUMMARY

A lint roller with a larger lint tape has more surface area, which increases the amount of debris that the lint roller can pick up with the exposed outer sheet. However, large lint rollers can be cumbersome to maneuver. The disclosed lint roller comprises at least two rolls of tape supported by a single handle. The rolls of tape independently rotate relative to one another. The lint roller provide more surface areas for picking up lint, hair, and debris, while also allowing for enhanced maneuverability of the lint roller. In one embodiment, the lint roller that comprises a handle, a first roll of tape, and a second roll of tape. The handle has a support with a first portion and a second portion. The first roll of tape has an outwardly facing surface with adhesive and rotatable about the first portion of the support. The second roll of tape has an outwardly facing surface with adhesive and rotatable about the second portion of the support. In one embodiment, the first portion and second portion of the support are aligned in a straight line. In one embodiment, the first portion and second portion of the support are aligned in lines parallel but offset from one another. In one embodiment, the first portion and the second portion of the support are non-linear relative to one another. In one embodiment, an angle formed between the first portion of the support and the second portion of the support is between 175 and 95 degrees. In one embodiment, the first portion of the support and the second portion of the support form a V-shape. In one embodiment, the first roll of tape is directly adjacent the second roll of tape on the support. In one embodiment, the first roll of tape is separated from the second roll of tape by the handle. In one embodiment, the first roll of tape has a first rotation and the second roll of tape has a second rotation, independent of the first rotation. In one embodiment, the lint roller further comprises a third roll of tape having an outwardly facing surface with adhesive and rotatable about a third portion of the support

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION

Figure 1:
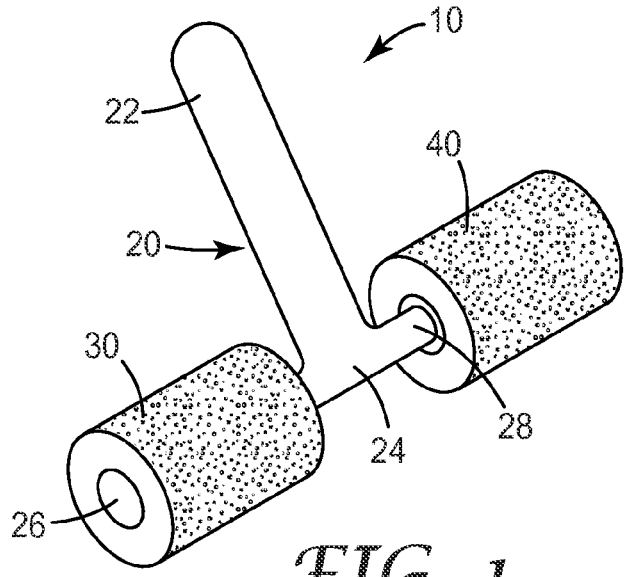
FIG. 1 is a perspective view of a first embodiment of a lint roller.

FIG. 1 is a perspective view of a lint roller 10. The lint roller 10 includes a handle 20, a first roll of tape 30, and a second roll of tape 40. The first roll of tape 30 and second roll of tape 40 are supported by the handle 20. The first roll of tape 30 and second roll of tape 40 are not directly connected to one another and therefore the first roll of tape 30 rotates independent from the second roll of tape 40.

The handle 20 includes a grip 22 and a support 24. The grip 22 is the extending portion of the handle 20 that supports a user's hand. As shown in FIG. 1, the lint roller 10 is of the configuration commonly referred to as a flat surface roller, wherein the grip 22 is generally perpendicular to the axis of rotation of the rolls of tape 30, 40.

The handle 20 further includes the support 24. The support 24 has a first portion 26 for supporting the first roll of tape 30 such that the first roll of tape 30 has a first rotation. The support 24 has a second portion 28 for supporting the second roll of tape 40 such that the second roll of tape 40 has a second rotation. As shown in the embodiment in FIG. 1, the first portion 26 of the support 24 is separated from the second portion 28 of the support 24 by the handle 20. In the embodiment in FIG. 1, the first portion 26 and second portion 28 of the support are aligned in a straight line.

In one embodiment, the support 24 may be rigidly connected with the grip 22 and handle 20 such that the rolls of tape 30, 40 rotate relative to a stationary support. In another embodiment, the support 24 may be rotatably connected with the grip 22 and handle 20 such that the support 24 itself rotates relative to the grip 22 and handle 20 and thereby allowing for the supported rolls of tape 30, 40 to rotate.

The first roll of tape 30 and second roll of tape 40 each comprises an elongated backing with an adhesive on the backing. The backing is formed into a roll of tape such that the adhesive is at the outwardly facing surface of the roll of tape. In one embodiment, the backing includes cuts or perforations to form a plurality of sheets that can be separated from the roll of tape when dirty.

For either or both rolls of tape 30, 40, the tape backing may include cuts or perforations such that the sheets have progressively increasing lengths, wherein when the sheets are wound into a roll, each sheet is longer than the sheet underneath it by an overlap length such as disclosed in U.S. Pat. No. 5,763,038, which is herein incorporated by reference.

For either or both rolls of tape 30, 40, the tape roll may be coreless and the first portion 26 of the support 24 or second portion 28 of the support 24 may be such as disclosed in U.S. Pat. No. 5,940,921 and U.S. Pat. No. 5,878,457, the disclosures of which are herein incorporated by reference.

It is understood that other configurations of a tape roll may be used. For example, the tape roll may be provided with or without a supporting core. The tape roll may be provided with or without cuts in the backing to provide individual sheets. If cuts are provided, the cut may be through the entire roll following formation of the roll or may be through the backing prior to formation of the roll of tape.

In use, the user holds the grip 22 and maneuvers the lint roller 10 over a surface to be cleaned. When pushing the lint roller 10 in a straight direction, the first rotation of the first roll of tape 30 is essentially equal to the second rotation of the second roll of tape 40. However, to push the lint roller 10 in a curving direction, the first rotation of the first roll of tape 30 may be more or less than the second rotation of the second roll of tape 40. To completely pivot the lint roller 10, the first rotation of the first roll of tape 30 may be in one direction while the second rotation of the second roll of tape 40 may be in directly the opposite direction.

Figure 2:
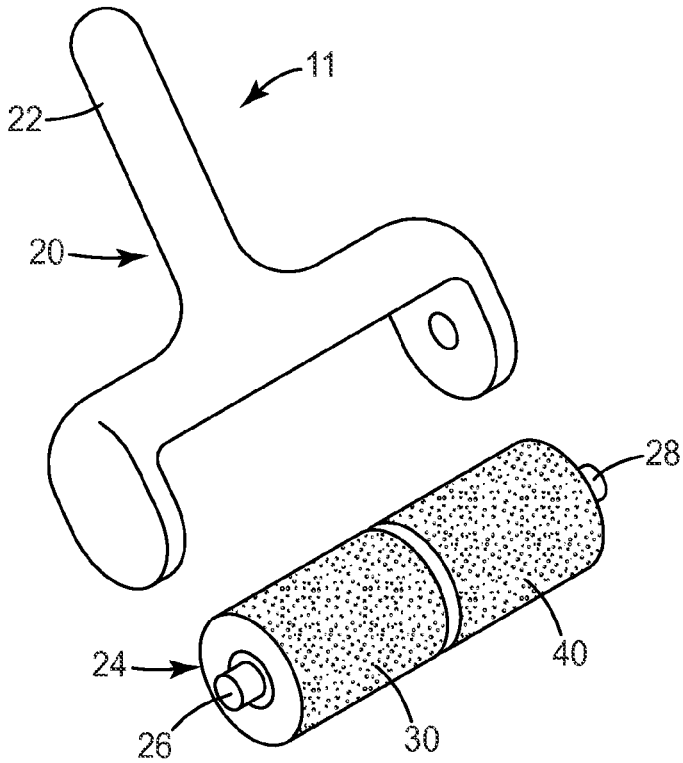
FIG. 2 is an exploded perspective view of a second embodiment of a lint roller.

FIG. 2 is an exploded perspective view of a lint roller 11 somewhat similar to that shown and described in FIG. 1. The lint roller 11 includes a handle 20, a first roll of tape 30, and a second roll of tape 40. The first roll of tape 30 and second roll of tape 40, shown removed from the handle but capable of being connected to the handle 20, are supported by a support 24. The support 24 has a first portion 26 for supporting the first roll of tape 30 such that the first roll of tape 30 has a first rotation. The support 26 has a second portion 28 for supporting the second roll of tape 40 such that the second roll of tape 40 has a second rotation. As shown in the embodiment in FIG. 2, the first portion 26 of the support 24 is directly adjacent to the second portion 28 of the support 24. It is understood that the first portion 26 and second portion 28 may be select areas of a single support 24 or may be independent sections of the support 24. In the embodiment in FIG. 2, the first portion 26 and second portion 28 of the support 24 are aligned in a straight line.

In the embodiment shown in FIG. 2, the support 24 may be entirely removable from the handle 20 to remove and load the rolls of tape 30, 40. Also, the support 24 may be pivotally connected at each end to the handle 20 to allow for removal and loading of the rolls of tape 30, 40.

Figure 3:
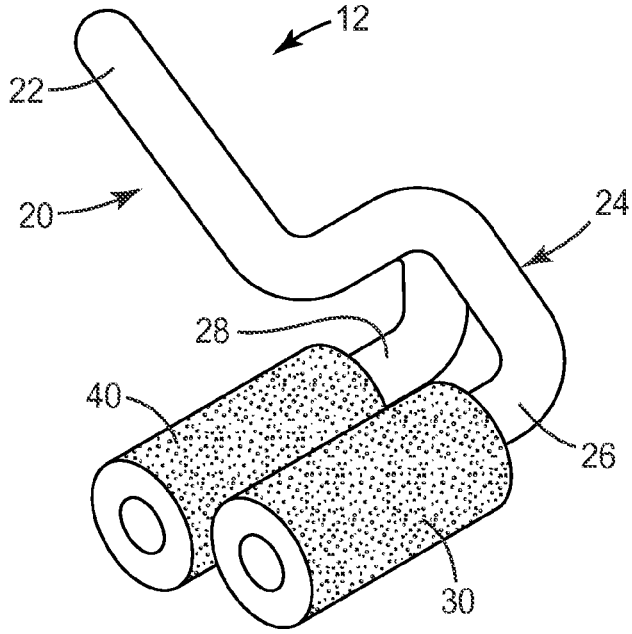
FIG. 3 is a perspective view of a third embodiment of a lint roller.

FIG. 3 is a perspective view of a lint roller 12 somewhat similar to that shown and described in FIG. 1. The lint roller 12 includes a handle 20, a first roll of tape 30, and a second roll of tape 40. The first roll of tape 30 is supported by a first portion 26 of a support 24 connected to the handle 20 and the second roll of tape 40 is supported by a second portion 28 of the support 24 connected to the handle 20. In this embodiment, the first portion 26 and second portion 28 of the support 24 are aligned in lines parallel, but offset from one another.

Figure 4:
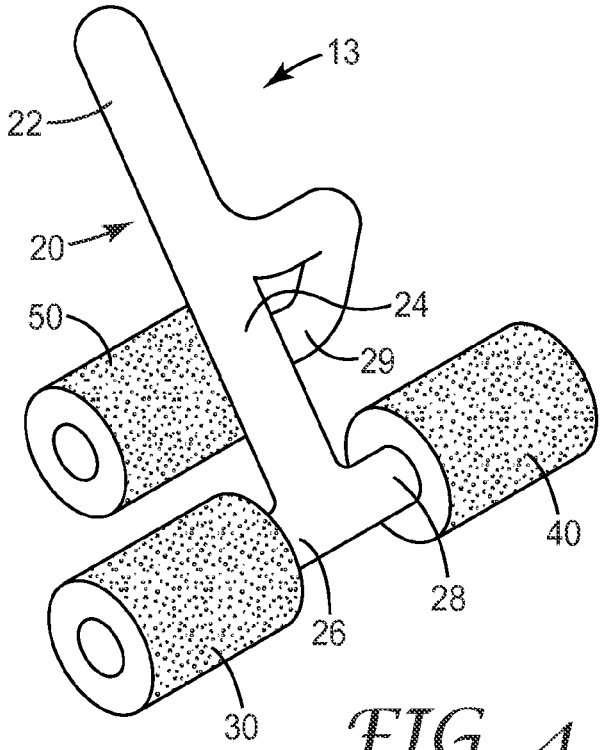
FIG. 4 is a perspective view of a fourth embodiment of a lint roller.

FIG. 4 is a perspective view of a lint roller 13 somewhat similar to that shown and described in FIG. 1. The lint roller 13 includes a handle 20, a first roll of tape 30, a second roll of tape 40, and a third roll of tape 50. The first roll of tape 30 is supported by a first portion 26 of a support 24 connected to the handle 20, the second roll of tape 40 is supported by a second portion 28 of the support 24 connected to the handle 20, and the third roll of tape 50 is supported by a third portion 29 of the support 24 connected to the handle 20. It is understood that the third roll of tape 50 includes a backing with an adhesive, wherein the adhesive is on an outer surface of the roll of tape and that in use the third roll of tape 50 rotates independent of the first roll 30 and second roll 40. In this embodiment, the first portion 26 and second portion 28 of the support 24 are aligned in straight lines while the third portion 29 is aligned in a line parallel, but offset from the first portion 26 and second portion 28. In this embodiment, the third roll of tape 50 can be provided to align with the gap created between the first roll of tape 30 and second roll of tape 40 such that in use when pushing the lint roller 13 from one edge of the overall lint roller 13 to the other edge of the lint roller 13 there is provided a continuous lint roller 30, 40, or 50 for picking up lint, hair or other debris. For the embodiment shown in FIG. 4, the third support 29 with the third roll of tape 50 can be selectively engaged with the surface being cleaned by the user actuating the handle 20 up and down.

Figure 5:
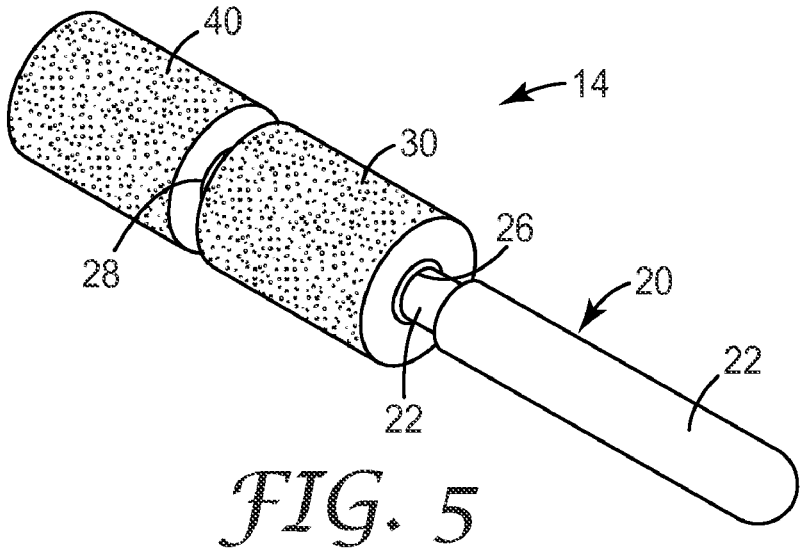
FIG. 5 is a perspective view of a fifth embodiment of a lint roller.

FIG. 5 is a perspective view of a lint roller 14 somewhat similar to that shown and described in FIG. 1. The lint roller 14 includes a handle 20, a first roll of tape 30 and a second roll of tape 40. The first roll of tape 30 is supported by a first portion 26 of a support 24 connected to the handle 20, and the second roll of tape 40 is supported by the second portion 28 of the support 24 connected to the handle 20. The first portion 26 of the support 24 and the second portion 28 of the support 24 are aligned in a straight line. Also, the grip 22 on the handle 20 is linearly aligned with the support 24 to provide a traditional lint roller. It is understood that the grip 22 may not be exactly linear and be slightly off set from alignment with the support 24.

Figure 6:
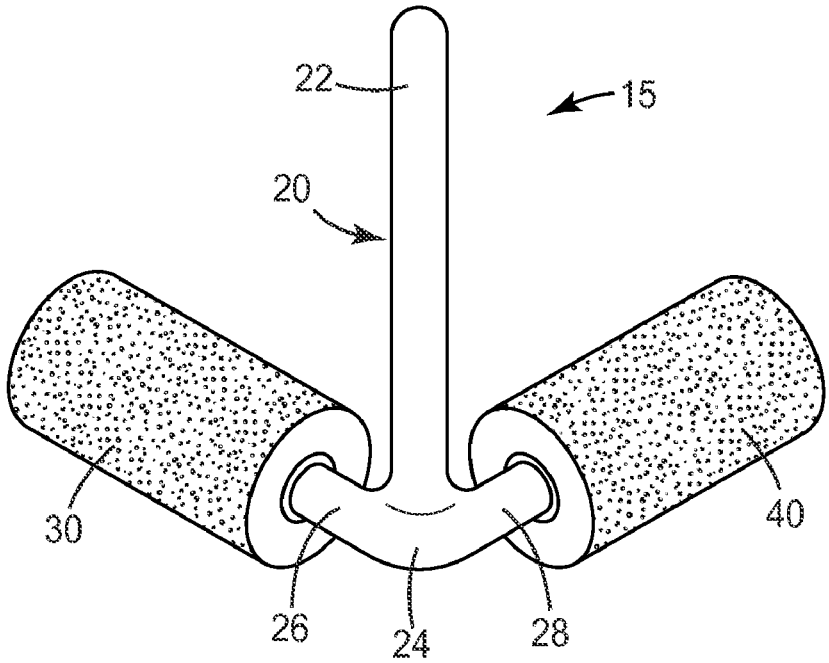
FIG. 6 is a perspective view of a sixth embodiment of a lint roller.

FIG. 6 is a perspective view of a lint roll 15 somewhat similar to that shown and described in FIG. 1. The lint roller 15 includes a handle 20, a first roll of tape 30, and a second roll of tape 40. The first roll of tape 30 is supported by a first portion 26 of a support 24 connected to the handle 20, and the second roll of tape 40 is supported by the second portion 28 of the support 24 connected to the handle 20. The first portion 26 of the support 24 and the second portion 28 of the support 24 are offset to form a "V" shape. In the embodiments shown in FIGS. 1-5, the angle between the first portion 26 and second portion 28 of the support 24 is 180 degrees. To form a V-shape, the first portion 26 is simply non-linear with the second portion 28. In another embodiment, the angle between the first portion 26 and second portion 28 should be less than 180 degrees. For example as shown in FIG. 6, the angle between the first portion 26 and second portion 28 is approximately 170 degrees. In one embodiment, the angle between the first portion 26 and second portion 28 is between 175 degrees and 90 degrees, in another embodiment the angle is between 170 degrees and 100 degrees. It is understood that for the embodiments shown in FIGS. 1-5 could be provided with first and second portions of the support 26, 28 with a V-shape.

The V-shape provides a particular advantage in use. In use, the user holds the grip 22 and maneuvers the lint roller 15 over a surface to be cleaned. When pushing the lint roller 10 in a straight direction, the first rotation of the first roll of tape 30 is essentially equal to the second rotation of the second roll of tape 40. However, because the direction of pushing the lint roller 15 is not directly aligned with the rotation of the roll of tape 30, 40, there is drag between the roll of tape 30, 40 and the surface being cleaned. This drag results in a wiping motion the work to catch and pull embedded lint, hair and other debris for the surface being cleaned. The smaller the angle between the first support 26 and second support 28 forming the V-shape, the more drag that the lint roll 15 will have during use.

It is understood that various features shown and described with respect to one embodiment may be interchangeable with features shown and described with another embodiment. It is understood that the description of the configuration of the rolls of tape and specific design configuration and arrangement of the support and handle may be interchangeable and applicable for the other embodiments.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A lint roller comprising:

a handle comprising a grip and a support having a first portion and a second portion;

a first roll of tape having an outwardly facing surface with adhesive and rotatable about the first portion of the support;

a second roll of tape having an outwardly facing surface with adhesive and rotatable about the second portion of the support;

wherein an included angle defined between the first portion of the support and the second portion of the support is between 175 and 95 degrees, the included angle having an apex and divergence of the first and second portions from the apex defining a rearward direction of the handle, the handle further defining a forward direction opposite the rearward direction;

and further wherein the grip extends from the support in the rearward direction.

2. The lint roller of claim 1, wherein the first portion of the support and the second portion of the support form a V-shape.

3. The lint roller of claim 1, wherein the first roll of tape is adjacent the second roll of tape on the support.

4. The lint roller of claim 1, wherein the first roll of tape is separated from the second roll of tape by the handle.

5. The lint roller of claim 1, wherein the first roll of tape has a first rotation and the second roll of tape has a second rotation, independent of the first rotation.

6. The lint roller of claim 1, wherein an entirety of an extension of the grip is spatially within the included angle.

7. The lint roller of claim 1, wherein an entirety of an extension of the grip is spatially between the first and second portions.

8. The lint roller of claim 1, wherein a center line of the grip intersects the apex.

9. The lint roller of claim 1, wherein a center line of the grip is aligned with a center line of the included angle.

10. The lint roller of claim 1, wherein the handle is configured such that a pushing force applied to the grip along a center line of the grip and in a direction of the apex is translated into a pulling force applied to each of the first and second portions.

11. The lint roller of claim 1, wherein the grip is configured and arranged such that a pushing force applied to the grip along a center line of the grip and in a direction of the apex causes the lint roller to move in the forward direction.

12. The lint roller of claim 1, wherein the included angle is approximately 170 degrees.

13. The lint roller of claim 1, wherein the first and second rolls of tape are each a coreless roll of tape.

* * * * *